United States Patent [19]

Sternberg

[11] Patent Number: 4,531,249

[45] Date of Patent: Jul. 30, 1985

[54] FLOOR-CARE APPLIANCE

[75] Inventor: Kurt Sternberg, Wuppertal, Fed. Rep. of Germany

[73] Assignee: Vorwerk & Co. Interholding GmbH, Wuppertal, Fed. Rep. of Germany

[21] Appl. No.: 539,877

[22] Filed: Oct. 7, 1983

[30] Foreign Application Priority Data

Oct. 23, 1982 [DE] Fed. Rep. of Germany ..... 3239347

[51] Int. Cl.[3] ..... A47L 11/18

[52] U.S. Cl. ..... 15/49 C; 51/176

[58] Field of Search ..... 15/49 C, 50 C, 98, 383, 15/389; 173/12; 51/176

[56] References Cited

U.S. PATENT DOCUMENTS 3,639,941 2/1972 Kirwan et al. ..... 15/389 X 4,351,078 9/1982 Sternberg ..... 15/49 C 4,360,939 11/1982 Krumm et al. ..... 15/49 C

*Primary Examiner*—Edward L. Roberts

*Attorney, Agent, or Firm*—Martin A. Farber

[57] ABSTRACT

The invention relates to a floor-care appliance with automatically adjusting vertical position of the brush-body rotary shaft. The shaft is placed in rotation via a drive belt from a motor, which shaft is borne by a rocker which is swingable as a function of the load on the brushes and is acted on in brush application position, and, in order to obtain a simplified construction with optimally constant work output, the rocker is swingable by the tension of the drive belt and has a deflection point which, from below, deflects the bottom-side pulling course of the drive belt.

18 Claims, 3 Drawing Figures

FLOOR-CARE APPLIANCE

The present invention relates to a floor-care appliance and more particularly, to a floor-care appliance where the position of the cleaning brushes is automatically adjusted.

It is known in the art to adjust the height of the brushes in a floor-care appliance.

West German OS No. 30 17 072 discloses a floor-care appliance with automatic adjustment of the position in height of a rotary shaft for brush bodies, which shaft can be placed in rotation by a motor via a drive belt, the shaft being carried by a rocker, which is swingable as a function of the load on the brushes and is acted on in brush application position. In this appliance the adjustment of the position in height of the shaft for the rotation of the brush body is effected via the moment of rotation of the drive motor. For this purpose it is necessary to suspend the drive motor with a turnable mounting and to connect it by means of pin-slot engagement with the rocker. This is, however, a construction which is expensive to manufacture.

The object of the present invention is to provide a floor-care appliance of the type in question whose construction is simplified and whose cost of manufacture is reduced. It is a further object that optimum, constant work output is obtained in a floor-care appliance even as the brushes are worn down.

According to the invention, a floor-care appliance is disclosed which provides automatic adjustment of the position in height of the rotary shaft for the brush bodies, the shaft being rotatable by a motor via a drive belt. The shaft is carried by a rocker (12) which is swingable as a function of the load on the brush bodies and is acted upon during use of the brush bodies. The rocker (12) is swingable by the tension of the drive belt (19) and has a deflection point 20 on a rocker arm (14) thereof opposite the rotary shaft (8), which deflection point deflects the bottom-side pulling course (19') of the drive belt (19), the belt extending from the drive shaft 8 to the motor (2). In this manner, tension on the belt determines brush body height.

As a result of the instant invention, the construction of a floor-care appliance of this type is simplified, which permits a saving in expense. Nevertheless, the floor-care appliance operates with optimum constant work output. The position in height of the shaft for the rotation of the brushes depends on the tension of the drive belt. If, for instance, the tension of the drive belt decreases as the result of too slight an application pressure on the brushes, the rocker swings and thereby brings the shaft for the rotation of the brush bodies into a position closer to the floor to be worked on. In case of too high an application pressure of the brushes, on the other hand, the tension of the drive belt increases, whereby the rocker is also displaced, in the manner that the shaft for the rotation of the brush bodies moves away from the carpet. The rocker is controlled in this case by the deflection point on the rocker which comes against the floor-side course of the belt. Different tensions in the latter lead to a corresponding swinging of the rocker. In a preferred embodiment, the deflection point comprises a tensioning roller. This development operates very sensitively and produces good operating results with reduced friction.

In order to be able to adapt the floor-care appliance to, for instance, carpets of different structure, the rocker is acted on by an adjustable spring in a direction opposite the moment of rotation which results from the tension of the drive belt.

In this case it is found favorable for the spring to be developed as a turning spring and for it to act via a gearwheel on an arcuate toothing on the rocker. In this way a favorable damping effect is produced, particularly when the floor-care appliance is turned on. The gear drive does not detrimentally impair the mounting of the rocker.

In order to prevent slippage of the drive belt upon the swinging of the rocker, the oppositely travelling course of the drive belt is also acted on by a tensioning roller provided on the rocker.

The adjustment of the different tension of the drive belt is facilitated by an indicating scale associated with the adjustable spring.

Also in a preferred embodiment, in the end regions of the swinging movement of the rocker it strikes on the one side against a limit switch and on the other side against stops.

The stops assure that the rocker does not leave its set position in accordance with its purpose even when same is at rest. During the operation of the floor-care appliance, the limit switch assures that the motor will stop in the event of too great a tension in the drive belt, caused, for instance, by too great a force applied to the brushes or by jamming thereof. The user of the floor-care appliance thus has the possibility of eliminating the disturbance or of setting a different value of brush-pressure. This measure protects the motor against overload in a particularly simple manner.

One illustrative embodiment of the invention will be described below with reference to FIGS. 1 to 3, in which.

Figure 1:
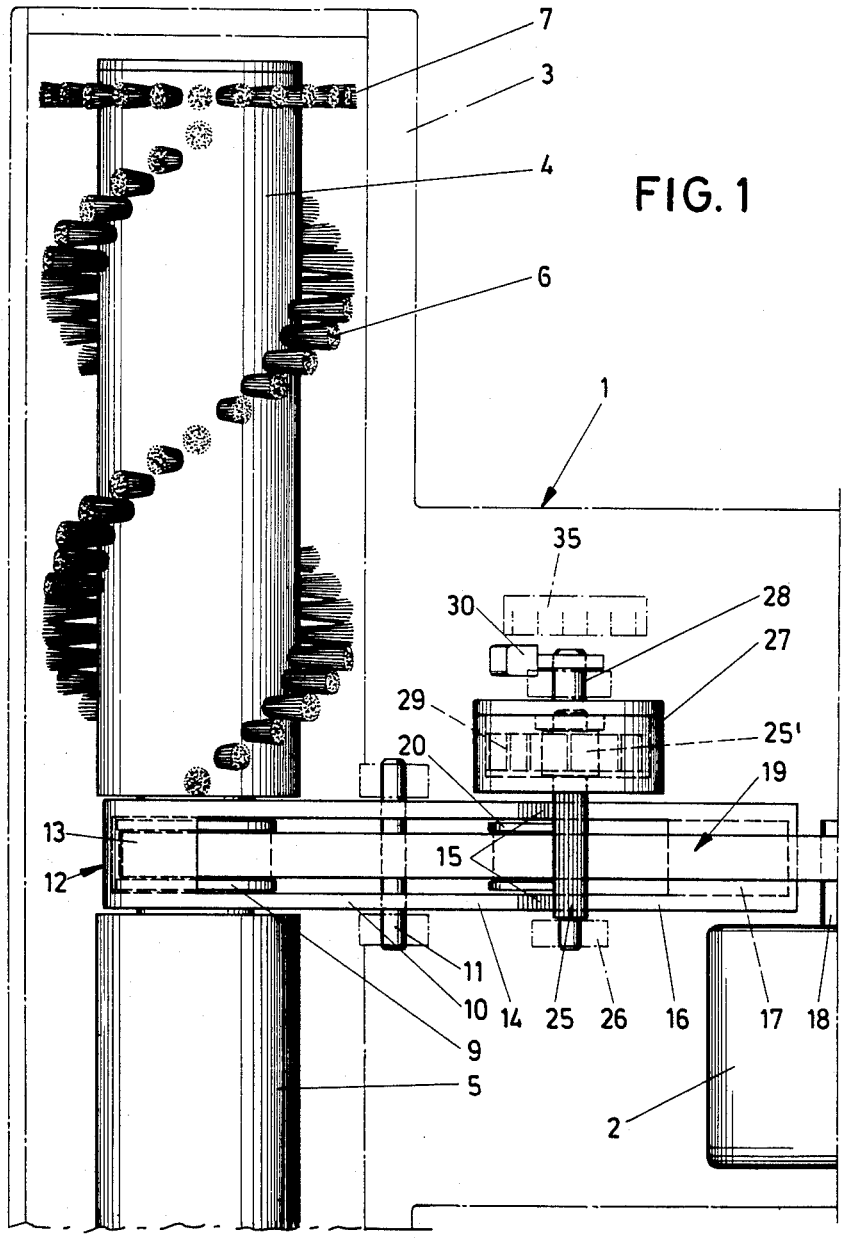
FIG. 1 shows, on approximately actual scale, in dot dash line the housing of a carpet sweeper which has brush bodies extending, overhung, on both sides of the drive point, the bristles and a portion of one brush body not being shown in order to simplify the drawing.

A floor-care appliance in accordance with the present invention comprises an approximately T-shaped housing 1, a portion of which is shown in dot-dashed line in FIG. 1. Within the stem of the T there is arranged an electric motor 2, while the cross bar 3 of the T has cantilevered brush bodies 4, 5 on both sides of the drive point. Bristles 6 are arranged helically on the brush bodies 4, 5. Furthermore, an edge ring consisting of bristles 7, is located on the end of the brush bodies. Although not fully shown, it will be understood that brush-body 5 is similar in construction to brush body 4.

The brush bodies 4, 5 are shown seated on a rotating brush-body shaft 8 which bears a drive pulley 9 at its center. The brush-body shaft 8 extends through the end of a rocker arm 10 of a rocker 12 which is supported turnably around a journal pin 11 provided on the housing. The rocker 12 preferably is developed as a double layer as seen in FIG. 1. The rocker arm 10 is connected at one end by an annular section 13 which partly extends around the drive pulley 9. Another rocker arm 14 of rocker 12 is provided with an arcuate toothing 15 which is concentric to the journal pin 11. An off-set end 16 adjoins the arcuate toothing. The two layers of rocker 12 at end 16 are connected together by a bridge 17.

A drive belt 19 is placed around the drive wheel 18 of the electric motor 2 and the drive pulley 9. The pulling course 19′ of the belt 19, which extends from the drive wheel 18 to the pulley 9, is deflected inward by a tensioning roller 20 which is mounted on the rocker arm 14. The tensioning roller 20 is seated on a pin 21 which extends within a vertical slot 22 in the rocker arm 14 and is fastened there in a given vertical position. A tensioning roller 23 is also associated with the oppositely directed course 19′ of the belt. This roller is mounted for turning around a pin 24 on the rocker 12.

Figure 2:
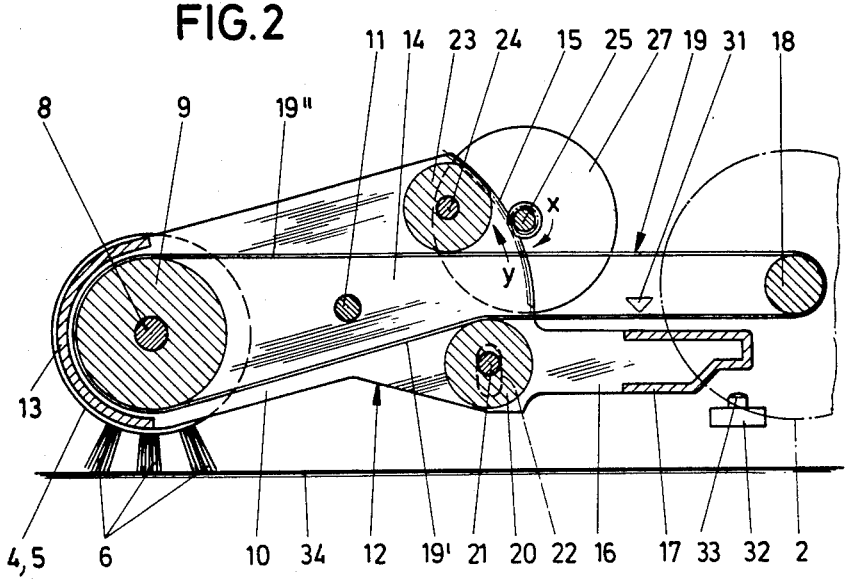
FIG. 2 shows diagrammatically a longitudinal section through the brush-body drive in position of rest.

The arcuate toothing 15 cooperates with a gearwheel 25. The latter is mounted, on the one side, in a bearing pedestal 26 of the housing 1 as seen in FIG. 1, and, on the other side, in a drum 27 which in its turn is continued by a pin 28 mounted on the housing. A turning spring 29 acts on the drum-side end 25′ of the gearwheel 25, the spring in its turn being fastened to the inner wall of the drum 27. By turning the drum 27 by means of a lever 30 arranged on the pin 28, a moment of rotation can be exerted in the direction of the arrow x on the gear, as seen in FIG. 2, which leads to a swinging of the rocker in the direction indicated by the arrow y. In this way the tensioning roller 20 is pressed with a given force against the course 19′ of the drive belt 19. A stop 31, against which the end 16 of the rocker arm 14 comes, limits this motion. Another stop (not shown) can extend approximately opposite the stop 31 where there may also be a limit switch 32, whose sensor pin 33 is at a certain distance from the rocker end 16.

Figure 3:
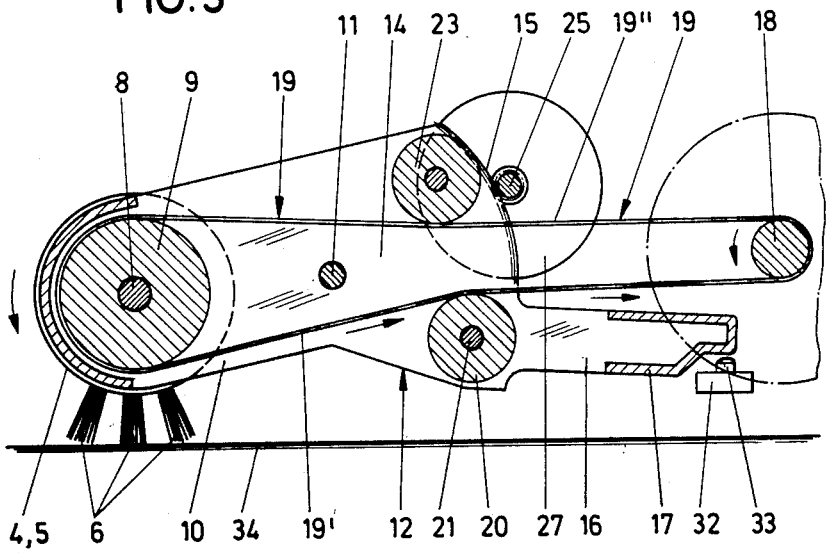
FIG. 3 is a diagram corresponding to FIG. 2 with the carpet sweeper in operation with rocker displaced and shaft for the rotation of the brush bodies therefore raised.

In operation, when the carpet sweeper is turned on, the drive wheel 18 rotates in counter-clockwise direction. The brush bodies 4, 5 are imparted the same direction of rotation via the drive belt 19. The deflected course 19′ of the belt present between the electric motor 2 and the brush bodies is placed under tension and thus strives to assume the stretched position. In this way pressure is exerted on the tensioning roller 20, which leads to a swinging of the rocker 12 into the position shown in FIG. 3. As a result, the distance between the rotary shaft 8 of the brush body and the surface of the carpet 34 increases.

Before the carpet sweeper is turned on or during its operation, adjustment of the bristle application pressure can be effected via the lever 30. An indicating scale 35 facilitates setting the desired bristle application pressure. If the bristle application pressure exceeds a predetermined value, this has the result that the course 19′ of the belt has greater tension thereon, leading, via the tensioning roller 20, to the swinging of the rocker 12 in clockwise direction. The brush-body shaft 8 is thereby moved a greater distance from the carpet 34. A reduction in the tensile stress of the course 19′ of the belt caused, for instance, by wear of the bristles, leads, on the other hand, to a swinging of the rocker in counter-clockwise direction. The bristles then press more strongly against the carpet 34, with a simultaneous increase of the tensile stress to the predetermined value.

If, for instance, the brush bodies 4, 5 are jammed then the tension of the pulling course 19′ of the belt increases and the rocker is swung, and its rocker arm 14 then strikes the limit switch 32 which stops the rotation of the electric motor 2.

When the carpet sweeper is turned on, the greater tension on the pulling course 19′ of the belt which suddenly takes place is taken up via the gearwheel drive by the turning spring 29. Damping takes place and the rocker is then returned into the predetermined position by the gearwheel drive, via the turning spring in the manner as aforesaid.

I claim:

1. A floor-care appliance having brush bodies on a rotary shaft, for automatic adjustment of the position in height of the rotary shaft and the brush bodies during application of the latter in operation, comprising:
   - a housing,
   - a motor fixed to said housing,
   - a drive belt,
   - a rocker pivotally mounted to said housing,
   - said rotary shaft being carried by said rocker, and
   - said drive belt operatively connected between said rotary shaft and said motor to transmit rotational motion therebetween, tension on said drive belt changing as a function of load on said brush bodies during the application of the latter in operation, and
   - means for swinging said rocker arm in response to the tension of the drive belt for automatically adjusting the position in height of said rotary shaft.

2. The floor-care appliance according to claim 1, wherein
   - said drive belt has a bottom-side pulling course,
   - said rocker has two rocker arms, one of said rocker arms is on a side of the rocker which is opposite said rotary shaft and said means for swinging includes a deflection means and said bottom-side pulling course of the drive belt, said deflection means deflects said bottom-side pulling course of the drive belt from a bottom of the bottom-side pulling course to swing said rocker arm.

3. The floor-care appliance according to claim 1, wherein
   - said deflection means comprises a tensioning roller secured to said housing.

4. The floor-care appliance according to claim 3, further comprising
   - a second tensioning roller mounted on said rocker, wherein
   - said drive belt has an upper-side traveling course engaging said second tensioning roller.

5. The floor-care appliance according to claim 3, wherein
   - said roller rotatably engages said drive belt.

6. The floor-care appliance according to claim 2, further comprising
   - an adjustable spring,
   - said rocker is biased by said adjustable spring against a moment of rotation on said rocker which results from the tension of the drive belt via said means for swinging.

7. The floor-care appliance according to claim 6, further comprising
   - a gearwheel,
   - said rocker defining an arcuate toothing engaging said gearwheel,
   - said spring further comprises a turning spring acting on said gearwheel and via the latter upon said arcuate toothing.

8. The floor-care appliance according to claim 6, further comprising
   - an indicating scale, means operatively connected with said adjustable spring for indicating on said scale a setting condition of the spring.

9. The floor-care appliance according to claim 8, wherein said means operatively connected with said adjustable spring includes a pointer lever, a gearwheel, said rocker has an arcuate toothing engaging said gearwheel, said spring further comprises a turning spring acting on said gearwheel and via the latter upon said arcuate toothing, a drum secured to said lever and rotatably mounted on said housing, said gearwheel is rotatably mounted relative to said drum, and said spring is connected to said drum and said gearwheel.

10. The floor-care appliance according to claim 2, further comprising a limit switch and a limit stop defining ends of movement of the swinging of the rocker, the latter striking, at one of said ends against said limit switch, and at another of said ends against said stop.

11. The floor-care appliance according to claim 1, wherein said drive belt has a pulling course, said rocker has two rocker arms, one of said rocker arms is on a side of the rocker which is opposite said rotary shaft and said means for swinging includes a deflection means and said pulling course of the drive belt, said deflection means deflects said pulling course of the drive belt to swing said rocker arm.

12. In a floor-care appliance having brush bodies on a rotary shaft, for automatic adjustment of the position in height of the rotary shaft and the brush bodies, the appliance comprising a rocker carrying said shaft, the shaft being rotatable by a motor via a drive belt, the improvement wherein said drive belt having a bottom-side pulling course, the tension on said drive belt changing as a function of load on said brush bodies during application of the latter in operation, said rocker being swingably mounted and having a rocker arm on a side of said rocker opposite said rotary shaft, and means including said drive belt and said means further comprising a deflection point deflecting the bottom-side pulling course of the drive belt from thereunder for swinging said rocker as a function of the tension on said drive belt.

13. The floor-care appliance according to claim 12, wherein said deflection point comprises a tensioning roller.

14. The floor-care appliance according to claim 13, further comprising a second tensioning roller mounted on said rocker, wherein said drive belt has an upper-side traveling course engaged by said second tensioning roller.

15. The floor-care appliance according to claim 12, further comprising an adjustable spring means for biasing said rocker against the swinging of said rocker caused by the tension of the drive belt via said deflection point.

16. The floor-care appliance according to claim 15, further comprising a gearwheel, said rocker defining an arcuate toothing engaging said gearwheel, said spring further comprises a turning spring acting on said gearwheel and via the latter upon said arcuate toothing.

17. The floor-care appliance according to claim 15, further comprising an indicating scale, means operatively connected with said adjustable spring means for indicating on said scale a condition of the spring means.

18. The floor-care appliance according to claim 12, further comprising a limit switch and a limit stop defining ends of movement of swing of the rocker, the latter striking, at one of said ends against said limit switch, and at another of said ends against said stop.

* * * * *